United States Patent [19]

Mathis

[11] 4,205,869

[45] Jun. 3, 1980

[54] APPARATUS FOR RECEIVING AND DISPOSING OF ANIMAL FECES

[76] Inventor: Lynda D. Mathis, 1980 Addison Rd., Marietta, Ga. 30066

[21] Appl. No.: 921,576

[22] Filed: Jul. 3, 1978

[51] Int. Cl.[2] ..... A01K 29/00

[52] U.S. Cl. ..... 294/1 B; 15/104.8; 206/223; 220/404

[58] Field of Search ..... 294/1 R, 19 R, 55; 15/104.8, 257.1, 257.6; 119/1; 206/223, 496; 220/404, 410; 229/37 R, 38, 41 R, 44 R

[56] References Cited

U.S. PATENT DOCUMENTS

| | | | |
|---|---|---|---|
| 3,144,979 | 8/1964 | Young | 229/37 R X |
| 3,684,155 | 8/1972 | Smith | 220/404 |
| 3,767,247 | 10/1973 | Wetzler | 15/257.1 X |
| 3,827,098 | 8/1974 | Sanderson | 294/1 R X |
| 3,830,423 | 8/1974 | Prescott | 294/1 R X |
| 3,854,578 | 12/1974 | Sharpe | 294/1 R X |
| 3,917,333 | 11/1975 | Grattan | 294/55 X |
| 3,971,503 | 7/1976 | Allan et al. | 15/257.1 X |

*Primary Examiner*—Johnny D. Cherry
*Attorney, Agent, or Firm*—Jones, Thomas & Askew

[57] ABSTRACT

A reusable apparatus for disposal of animal feces. The apparatus comprises a collapsible and reusable cardboard container, a supply of disposable sealable plastic bags which can fit as a liner within the cardboard container, and a small disposable scoop or paddle associated with each plastic bag.

4 Claims, 3 Drawing Figures

Fig. 1
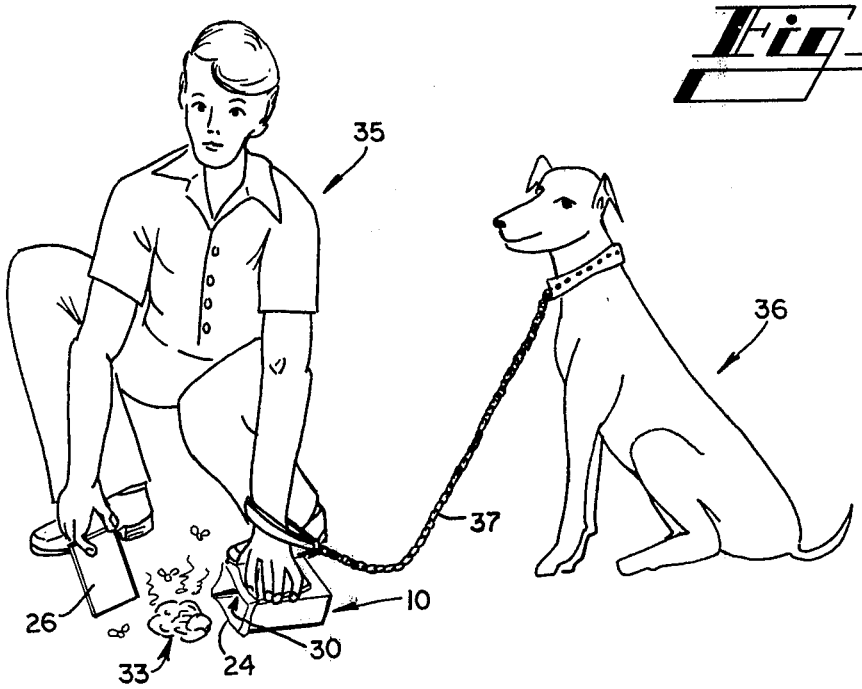
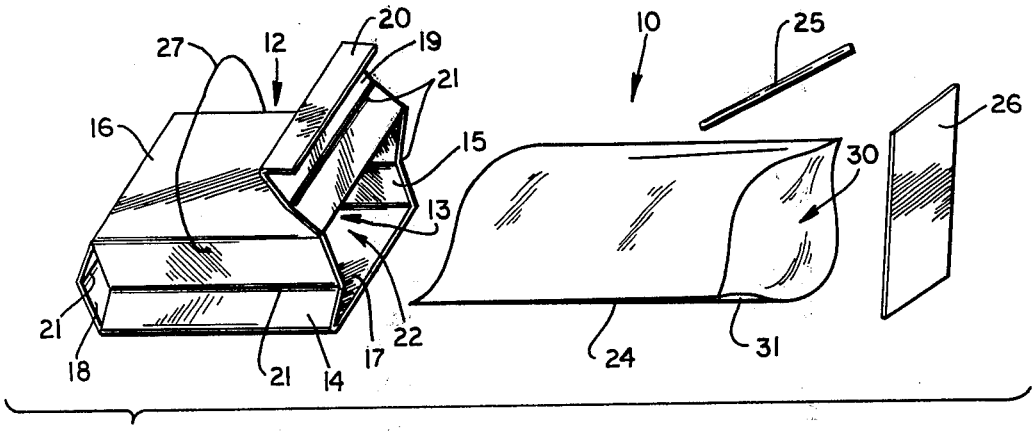
Fig. 2
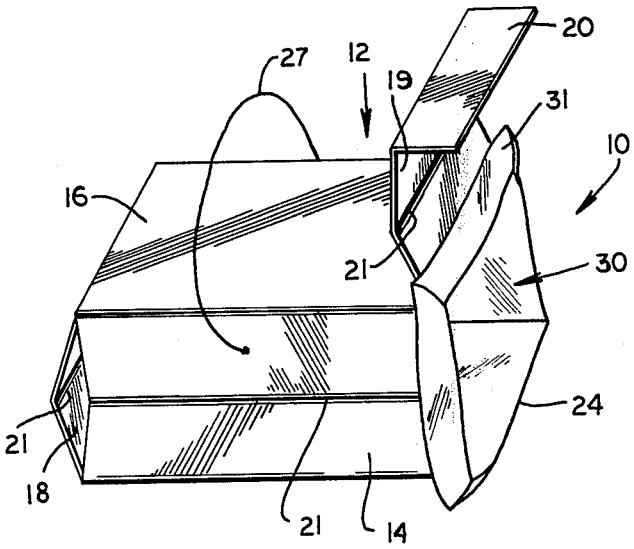
Fig. 3

APPARATUS FOR RECEIVING AND DISPOSING OF ANIMAL FECES

BACKGROUND OF THE INVENTION

The present invention relates to an apparatus and method of collecting messy substances such as dog feces.

City life has long been criticized for its inconveniences, its smells, its filth and its dangers. A major contributor to these unpleasant city conditions is the ever increasing, randomly distributed quantity of dog stools (feces). City dwellers have long smelt the need to rid their sidewalks, plazas and parks of these unsightly statuettes. Disgust-inspired public opinion is resulting more and more in city ordinances requiring dog owners to clean up after their dogs.

Clean up is no easy or appealing task and whereas solutions to the problems of animal excrements are numerous, they are not always practical. Horses can wear diapers, cats have a litter box; newspapers and shovels have long been pressed into clean up of offensive deposits left by domestic animals. There are disposable dust pans for cleaning up garbage of all kinds. There are garbage cans, even with plastic liners, that can be loaded and the liners eventually disposed of.

Despite the numerous clean up solutions, there appears to be no practical aid for the typical dog walker who desires to travel through the parks or on the sidewalks with his dog. Most clean up devices are cumbersome and do not lend themselves to being carried along on a dog walk, i.e., from shrub to shrub and post to post. A dog walker should be able to quickly and easily collect the dog's mess and carry it some distance along the way of his public "dog walk" until a suitable disposal area can be arrived at. The means of collecting and disposing should be sanitary, and it should provide odorless and sightly transportation of the feces until it can be disposed of.

SUMMARY OF THE INVENTION

Briefly described, the present invention comprises a collapsible disposable cardboard container, a supply of disposable plastic bags which can fit as a liner within the cardboard container, and a small disposable scoop or paddle associated with each plastic bag. In use, a person walking a dog would carry the box in collapsed condition in a pants pocket or purse, along with one or more bags and scoops. In the event that the pooch does a no-no, its owner will use the paddle to urge the incriminating evidence into one of the plastic bags, with which he has lined the container. The soiled scoop is also deposited in the bag, which can then be sealed within and conveniently carried in the container. The bag and its offending contents can be deposited in the nearest waste receptacle, after which the box, which remains unsoiled thanks to the use of the plastic liner, can be collasped and placed back in the person's pocket to await subsequent reuse.

Therefore, an object of the present invention is to provide an animal feces disposal apparatus which is easily carried by a dog walker.

Another object of the present invention is to provide an animal feces disposal apparatus which is at least partially reusable and therefore does not require carrying a number of bulky devices.

Yet another object of the present invention is to provide a means by which animal feces and other messy substances can be collected, carried and disposed of in an unoffensive and sanitary manner.

Other objects, features and advantages of the present invention will become apparent upon reading the following specification, when taken in conjunction with the accompanying drawings.

BRIEF DESCRIPTION OF THE DRAWING

FIG. 1 is a pictorial rendition of the animal feces disposal apparatus according to an embodiment of the present invention, in use.

FIG. 2 is an exploded pictorial view of the disclosed apparatus.

FIG. 3 is a pictorial view of the outer container and inserted liner of the apparatus of FIG. 2.

DETAILED DESCRIPTION

Referring now to the drawings in which like numerals represent like components throughout the various views, FIG. 1 shows the toteable aniaml litter collecting box 10 of the present invention in use. The collecting box 10, as seen in FIG. 2, comprises an outer container 12 which is generally rectangular in shape. The outer container 12 includes two opposing side walls 14, 15, top wall 16, bottom wall 17, back end wall 18 and a front end wall 19. The walls 14, 15, 16, 17, 18, 19 surround and define the interior compartment space 13 of the box 10. The container 12 is constructed so as to be collapsible, bringing the top and bottom walls 16, 17 into close proximity with one another, so as to be easily stored in a purse or pants pocket. In order to facilitate collapse of the container 12, each of the side walls 14, 15 and each of the end walls 19, 18 has a fold line or crease 21 formed in the walls 14, 15, 18, 19 approximately midway between the top and bottom walls 16, 17 and running parallel to the planes of the top and bottom walls. The front end wall 19 is attached only to the top wall 16 so that the front end wall can serve as a hinged lid selectively covering the container opening 22 through which access can be had to the compartment space 13. The lid formed by the front end wall 19 has an added flap 20, protruding from its free end, which can be tucked into the compartment space 13 to hold the lid in place when it is closed. The back end wall 18 and two side walls are all attached to the top and bottom walls 16, 17, but are not attached to one another so as to facilitate collapse of the box 10.

Other components of the toteable collecting box 10 include a disposable liner or insert 24, a sealing device 25 and a scraper 26. A handle 27 is also provided, attached to the outer container 12 for easy carrying of the box 10. The liner or insert 24 can be of any material or configuration, and the purpose of the insert is to line the outer container 12 so that the container 12 does not become soiled by animal litter or other substance collected. The liner 24 should likewise have a liner opening 30 which can be aligned with the container opening 22 when the liner is inserted into the container 12.

The liner 24 of the disclosed embodiment is a bag 24, preferably a small airtight plastic bag, and the sealing device 25 is a wire twist tie 25. The scraper 26 can have any convenient form, and can simply be a rectangular flat member as depicted. Preferably, the scraper 26 is made of stiff material and is of such size that it can be inserted into the liner 24 after the scraper has been used. A rectangular piece of heavy cardboard is depicted in the present embodiment.

The outer container 12 is designed to be a resuable holder which, when empty, is collapsible and fits in a purse or pants pocket. The liner 24, twist tie 25 and scraper 26 are all disposable and are intended to be disposed of after a single use. A user 35 should have a quantity of liners 24, ties 25 and scrapers 26 on hand.

In its preferred application, the present invention is used by a dog walker 35 to clean up a dog mess 33 left in an unattractive spot by his or her dog 36. The toteable animal litter box 10 of the disclosed embodiment is used to collect and dispose of the ill-placed dog mess 33 in the following manner: the user or dog walker 35, while walking his or her dog 36 on a leash 37 carries the collapsed outer container 12, along with at least one set of liner 24, twist tie 25 and scraper 26, in his pocket or her purse (or vice-versa). Dog 36, out of necessity, haplessly evacuates, leaving a mess 33 in an unattractive or even illegal spot. Walker 35, still holding the leash 37, removes the litter box contents 12, 24, 25, 26 from his pocket; uncollapses the outer container 12; flips up the lid; inserts the bag liner 24 into the container 12 so that the liner opening 30 and container opening 22 are in alignment; and turns the edges 31 at the liner opening 30 back about the edges of the container opening 22 to protect the container 12 and to hold the liner 24 in place. Holding the container 12 with the inserted liner 24 in one hand, the walker 35 takes the scraper 26 in his other hand and scrapes the mess 33 into the bag liner 24 through the liner opening 30. After the mess 33 has been collected in the liner 24, mess collector 35 inserts the used, soiled scraper 26 into the liner 24 with the mess; gathers together the liner edges 31; seals closed the liner opening 30 by wrapping the twist tie 25 tightly around the collected edges 31; and closes the outer container lid 19. With the mess 33 and soiled scraper 26 sealed in the liner 24 within the container 12, dog walker 35 picks up the container by the handle 27 and resumes walking dog 36. During the continuation of their walk, as walker 35 and dog 36 pass a convenient appropriate disposal area such as a garbage can or litter basket, walker simply opens the container lid 19; pulls out the sealed liner 24; and deposits it, with its sealed-in contents, into the garbage can. Walker 36 then collapses the outer container 12 by pressing the top and bottom walls 16, 17 toward one another thus folding the side walls 14, 15 and end walls 18, 19 along their fold lines 21; and places the reusable container back in his pocket to await another occurrence. should nature so demand, a fresh, unsoiled set of liner 24, twist tie 25 and scraper 26 is readily pressed into service.

While this invention has been described in detail with particular reference to a preferred embodiment thereof, it will be understood that variations and modifications can be effected within the spirit and scope of the invention as described hereinbefore and as defined in the appended claims.

What is claimed is:

1. A portable apparatus for collecting and disposing of animal feces and other substances, said apparatus comprising:

a collapsible toteable reusable container defining an enclosed compartment therein, said container including an opening for obtaining access to said compartment and a lid selectively positionable over said opening;

said lid comprising an end wall of said container;

means defining a hinge interconnection between said end wall and an exterior wall of said container so that said hinge interconnection is operative to enable said end wall to be selectably opened and folded back on the outside of said exterior wall;

said lid further comprising means to engage said container and detachably retain said end wall in position covering said opening when said end wall is selectively positioned over said opening;

a bag-like insert for removable insertion into said compartment of said container, said insert having a closed end and an open end;

said open end of said insert being substantially juxtaposed with said opening in said container when inserted therein, and being sufficiently larger than said opening so that the open end can be folded back to extend along and cover the outside of the container including said hinge interconnection and part of said folded-back end wall peripheral to said opening, thereby protectively covering the periphery of said opening from contamination as animal feces or other substances are scraped into said insert;

a scraping device for scraping animal feces and other substances into said bag-like insert, said scraping means being itself totally insertable within said insert; and sealing means for sealing closed said bag-like insert with said animal feces and said scraping device enclosed therein, whereby said insert is inserted into said container with the opening of said bag-like insert aligned with the opening of the container, animal feces are scraped into said insert within said container, said scraping device is inserted into said insert, and said insert is sealed by said sealing means and carried in said toteable container to an appropriate location where said sealed insert is removed from said container and disposed of after which said container is collapsed to await further use.

2. The apparatus of claim 1 and further including a handle attached to said container.

3. The apparatus of claim 1, wherein said container further comprises:

opposite side walls, a top wall, a bottom wall, a back end wall and a front end wall;

said front end wall comprising said openable end wall through which access can be gained to said enclosed compartment; and a separate fold line formed longitudinally along the entire extent of each of said opposite side walls, back end wall, and front end wall whereby each of said side walls, said back end wall and said front end wall is foldable along said fold line bringing said top and bottom wall into close flat proximity to one another to collapse said collapsible container from an expanded operative condition, and to selectably restore said container to its expanded condition ready to receive another bag-like insert.

4. Apparatus as in claim 1, wherein said hinge interconnection means is operative to enable said end wall to be opened and folded back to form an acute angle with the outside of said exterior wall, so that the open end of said insert can be folded back to cover said end wall along said hinge interconnection.

* * * * *